United States Patent [19]

McGonagle

[11] Patent Number: 4,986,330

[45] Date of Patent: Jan. 22, 1991

[54] PRIVACY BOOTH

[76] Inventor: Patrick E. McGonagle, 46 St. John's Park, Buncrana Road, Londonderry, Northern Ireland

[21] Appl. No.: 357,958

[22] Filed: May 30, 1989

[51] Int. Cl.[5] ..... A47G 5/00

[52] U.S. Cl. ..... 160/135; 52/36; 52/70; 52/239; 108/41

[58] Field of Search ..... 52/36, 239, 70, 71; 160/135, 351, 229.1; 108/33, 34, 35, 41, 111, 115, 152

[56] References Cited

U.S. PATENT DOCUMENTS

| | | | |
|---|---|---|---|
| 510,427 | 12/1893 | Hine | 160/135 |
| 1,045,854 | 12/1912 | Kevitt et al. | 160/135 |
| 1,449,780 | 3/1923 | Reinhold | 160/135 X |
| 1,455,569 | 5/1923 | Caminoni | 108/41 |
| 3,463,218 | 8/1969 | Cannon et al. | 160/135 |
| 3,559,352 | 2/1971 | Magnuson | 52/36 |
| 3,565,152 | 2/1971 | Cohn, Jr. | 160/135 |
| 4,020,604 | 5/1977 | Legler et al. | 52/70 X |

FOREIGN PATENT DOCUMENTS

| | | |
|---|---|---|
| 590345 | 7/1947 | United Kingdom . |
| 1356092 | 6/1974 | United Kingdom . |
| 1388051 | 3/1975 | United Kingdom . |
| 2196663 | 5/1988 | United Kingdom . |

*Primary Examiner*—John E. Murtagh

[57] ABSTRACT

A collapsible privacy booth, for example a polling booth, includes a plurality of partition members mounted together for pivotable movement from a storage position in a which the partition members are in superimposed side-by-side relationship to an in-use position in which the partition members extend substantially radially away from a common vertical axis to define at least two separate compartments. Each partition member includes a table top pivotable along a lower edge of the partition member and movable from a storage position folded against the partition member to an in-use position in which the table top extends between the two partition members defining the compartment. Telescopic support legs for the partition members permit adjustment of the height of the table tops.

5 Claims, 5 Drawing Sheets

PRIVACY BOOTH

BACKGROUND OF THE INVENTION

1. Field of the Invention

This invention relates to a privacy booth, for example a polling booth, which can be collapsed and packaged in a flat carton thereby enabling a large number of units to be easily stored, handled and transported.

2. Description of Related Art

Polling booths are in general use thoughtout the world and are often constructed, from plywood sheets and wooden laths that ae assembled with tie-pieces and pegs so as to form a table-lke structure which is subsequently divided into bays by placing a multiple open-sided box structure on top.

Booths of this type are variable in size and shape, usually having been constructed in each town by local carpenters, and consequently give rise to severe problems in logistics when they are required to be delivered and erected in a matter of days, or even hours, before election day. Moreover, they require the fitting skill of the carpenter during erection and dismantling and all individual pieces, such as pegs and ties, are stored separately from the plywood sheet in which they are used; such segregation destroys the efficiency concept of unit-packing.

According to the present invention there is provided a privacy booth comprising a plurality of partition members mounted together for rivating movement from a storage position in which the partition members are in superimposed side-by-side relationship to an in-use position in which the partition members extend substantially radially away from a common vertical axis to define at least two separate compartments, in which one of each pair of partition members defining a compartment includes a table top pivotted to the partition member and movable from a storage position in which the table top is folded against the partition member to an in-use position in which the table top extends between the two partition members defining the compartment.

The partition members are preferably supported above ground level by telescopic legs so that in use the table top is at a height above ground level to enable a person to sit at the table top.

Preferably, there is provided securing means for securing each table top in its in-use position and also in its storage position.

The advantage of the invention is that the booth may be rapidly assembled and disassembled as required, and may be folded to a collapsed position to fit into a container of the so-called flat pack type.

BRIEF DESCRIPTION OF THE DRAWINGS

An embodiment of the invention will now be described, by way of example, with reference to the accompanying drawings, in which.

DETAILED DESCRIPTION OF PREFERRED EMBODIMENTS

Figure 1:
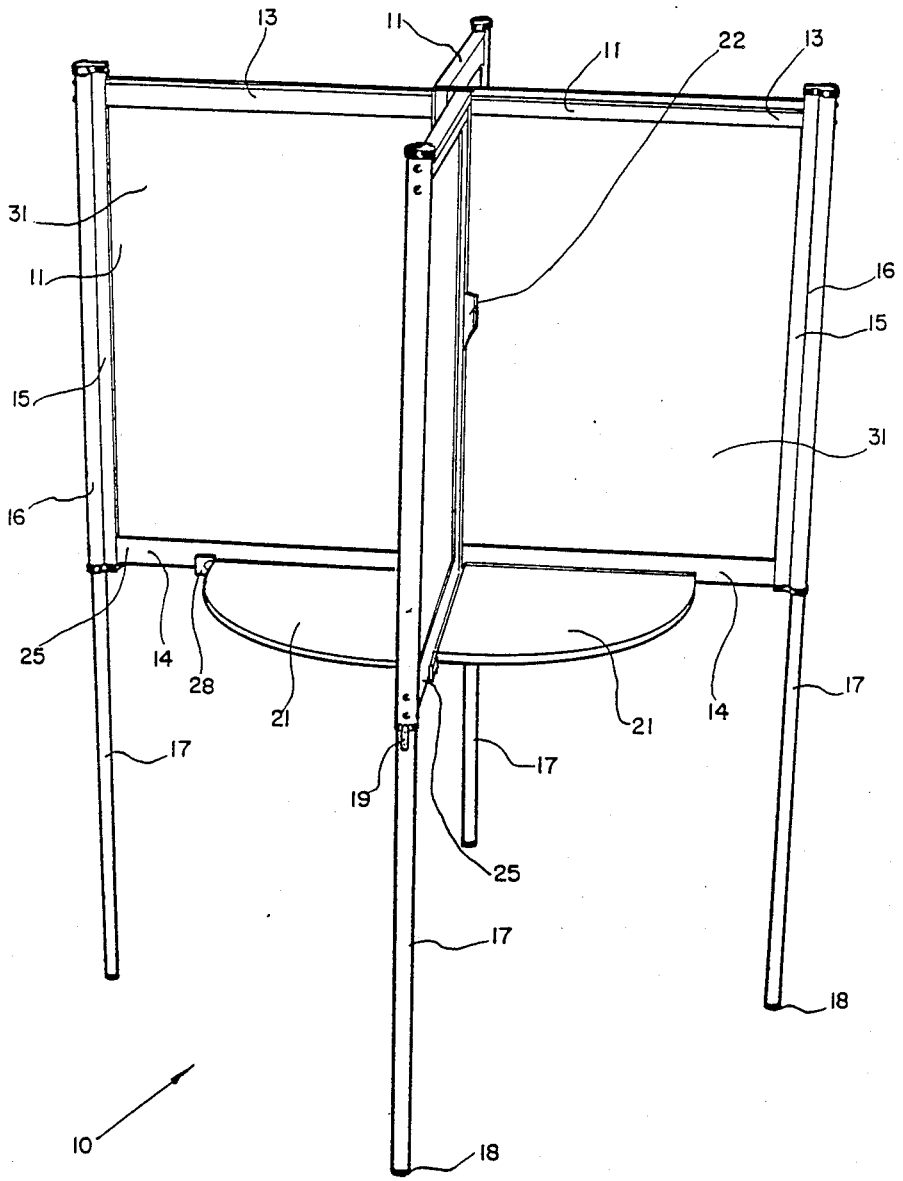
FIG. 1 is a perspective view of a fully assembled privacy booth according to the invention.

Referring now to the drawings wherein similar numerals have been used to indicate like parts, there is shown therein a privacy booth generaly indicated at 10 according to the invention. The privacy booth 10 comprises a plurality of partition members 11 each of which comprises an inner edge 12, upper and lower substantially horizontal edges formed by hollow frame members 13 and 14 respectively, and an outer substantially vertical edge 15 in the form of a further hollow frame member 16. The latter accomodates a telescopic ground-engaging leg 17 which extends downwardly beyond the outer end of the lower edge 14 of the partition member 11 and has an adjustable foot 18. Each leg 17 may be telescoped substantially fully up inside the respective hollow frame member 16 when not in use and a spring biased locking pin 19 is provided in the leg 17 to prevent downward movement of the partition member 11 on the leg 17 when in the in-use position. To retract the leg 17 inside the frame member 16, the leg 17 is extended until the pin 19 clears the lower edge of the frame member 16, and the pin 19 is pressed inwards allowing the leg 17 to be pushed into the frame member 16.

Figure 2:
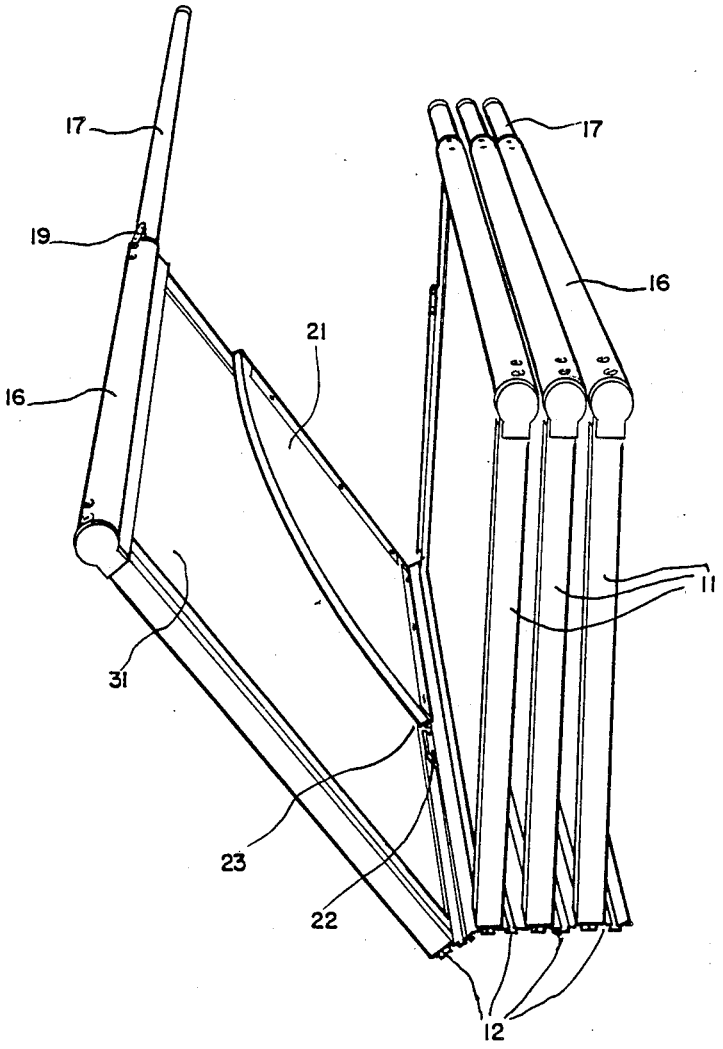
FIG. 2 is a perspective view of the booth of FIG. 1 in a collapsed position.
Figure 3:
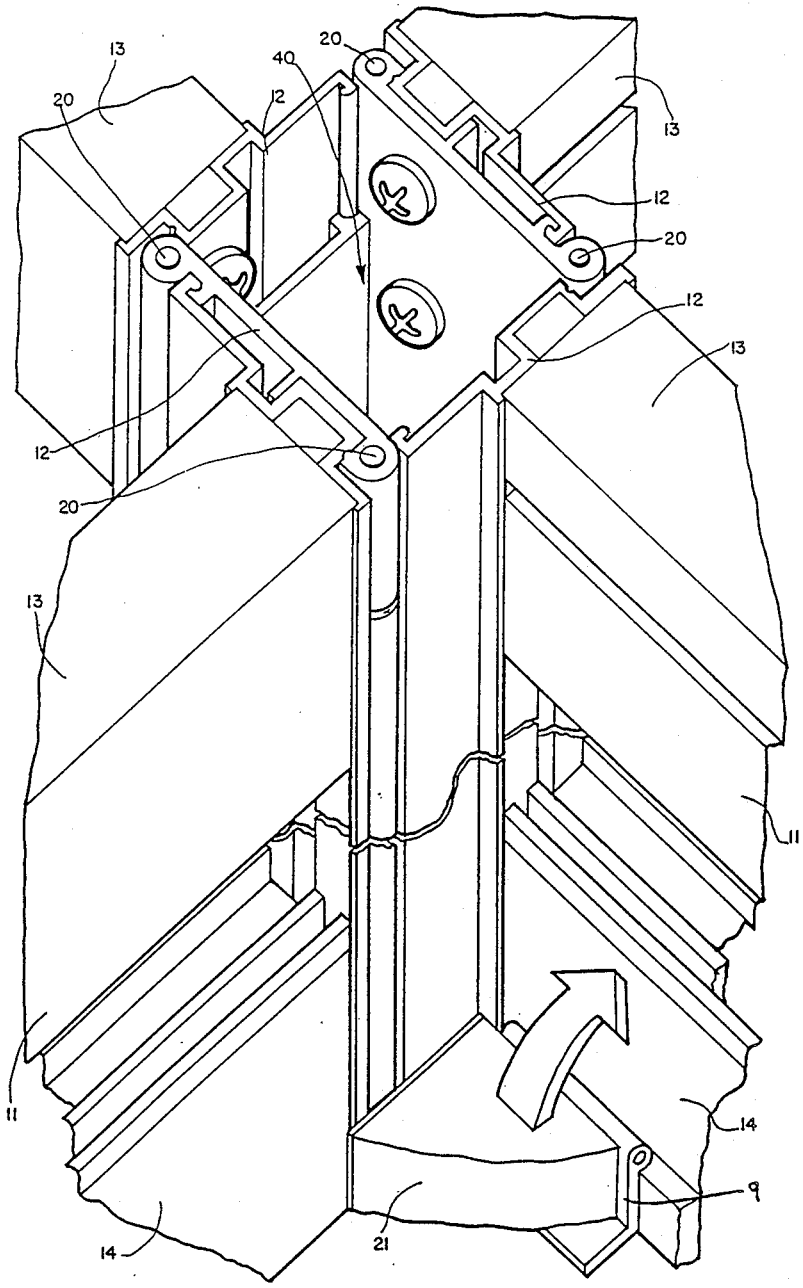
FIG. 3 is diagramatic perspective view of the privacy booth showing detail of the inner edges of the partition members.
Figure 4:
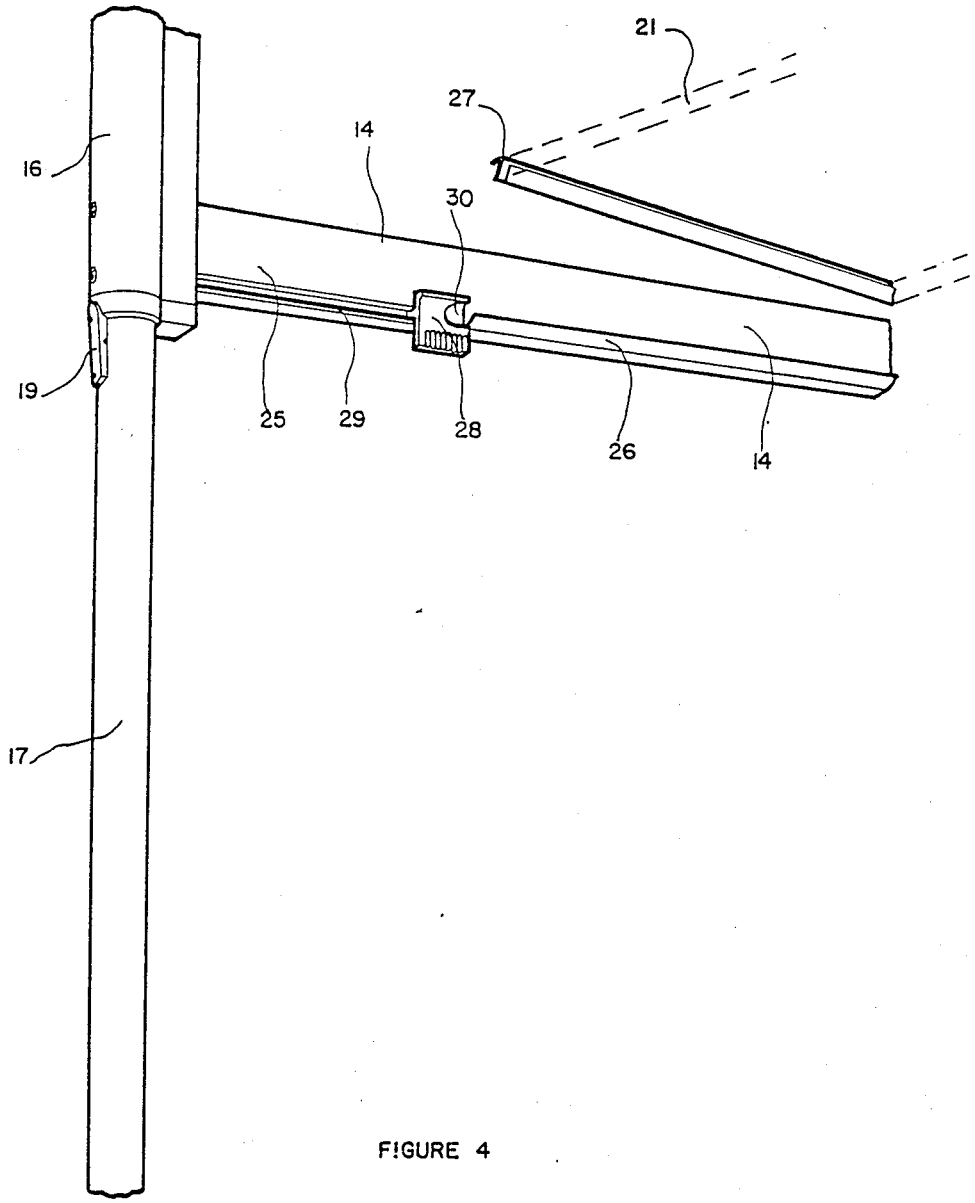
FIG. 4 is a partial perspective view of one of the partition members, showing the securing means.

As shown in FIG. 3, the inner edges 12 of the partition members 11 are hinged together by multiple hinges 20 so that the partition members 11 can be pivoted from a storage position in which the members 11 are in superimposed side by side relationship as shown in FIG. 2 to an in-use position in which the partition members extend substantially radially away from a common vertical axis (FIG. 1).

A respective table top 21 is pivated along each of the frame members 14 forming the lower edges of the partition members 11 by means of a pivotally mounted support 9. The table top 21 may be pivoted from a storage position folded up against the partition member 11 (FIG. 2) when not in use, to an in-use position in which the table top extends between two adjacent partition members. A spring-loaded locking member 22 which is vertically movable is mounted adjacent the inner edge 12 of each partition member 11. The locking member 22 is arranged to engage with the inner edge 23 of the table top 21 to lock the table top in juxta-position with the partition member 11, as shown in FIG. 2. A spring (not shown) holds the locking member 22 in engagement with the table top. To release the table top 21, the locking member 22 is simply moved upwards slightly against the spring bias.

The side 25 of each frame member 14, opposite to the side on which the table top 21 is pivotally mounted, is provided with a flange 26 onto which the edge 27 of the table top 21 can be engaged. A locking member 28 is also axially slidable in a channel 29 in the side 25 of each frame member 14, the locking member 28 having a recess 30 which acommodates the ends of the flange 26 and edge 27 of the table top 21, so that the table top is effectively releasably secured to the flange 26 and thus the adjacent partition member 11. This arrangement provides secure fixing of the privacy booth in the in-use position.

Figure 5:
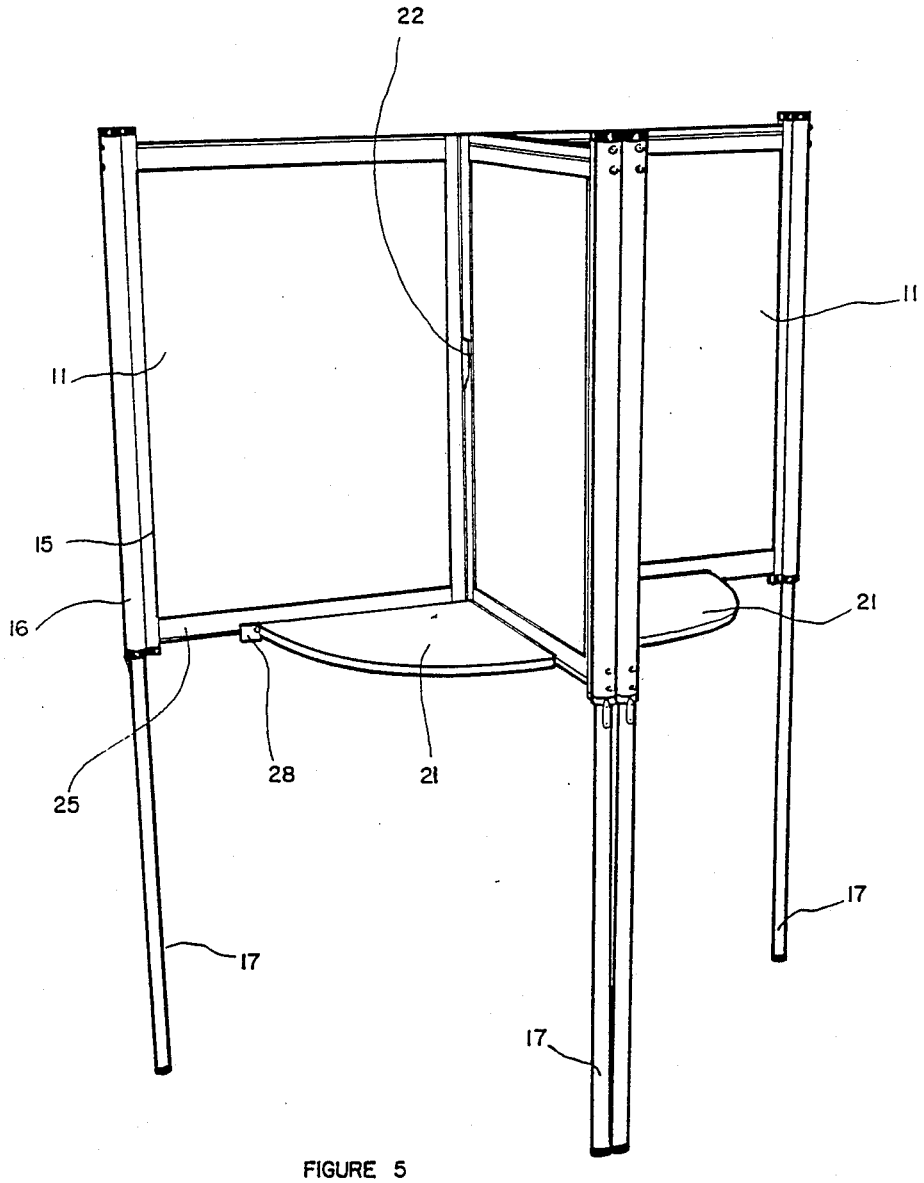
FIG. 5 is a perspective view of the privacy booth of FIG. 1 in a two-booth configuration.

Thus, the invention provides a simple construction of a privacy booth which may be readily assembled to the in use position shown in FIG. 1 to provide four separate private compartments defined between the partition members 11, and readily collapsed to the storage position of FIG. 2. It will be appreciated that any desired maximum number of compartments may be provided and in the embodiment described up to four compartments may be provided. In FIG. 5 there is shown the booth of FIGS. 1 through 4 configured such that only two compartments are provided as required.

It will be appreciated that the basic features of the booth can be varied to suit individual circumstances. For example, suitable spikes (not shown) can be provided which engage the feet 18 and which can be fixed into the ground surface if the booths are to be used out of doors. A parasol can be secured above the booth by a suitable fitting which engages in the rectangular recess 40 defined between the inner edges 12 of the partition members. A curtain (not shown), as described in the Applicant's published British patent specification No. GB 2,196,663 A can be provided around the booth. Rather than the legs 17 being capable of being telescoped inside the frame member 16, they may be foldable by providing a suitable hinge and a locking means to lock them in their extended position. It will be understood that in the construction described herein, the legs are of a length which provide for a length of approximately one quarter to one third of the exposed length to be engaged inside the frame member 16 when in the in-use position to provide enhanced stability. In addition, further supporting struts may be provided if necessary or desired.

It will be appreciated that in the embodiment described, the partition members comprise frame members 13, 14, 16 and an inner edge 12 together with a panel 31 located between these members. In an alternative construction the panel 31 may be integrally formed with either or all of the members 12, 13, 14 and 16. In addition, a flexible member may be provided which is removably secured to the partitions 11 by enaging with the upper and lower frame members 13 and 14. Such a flexible member may carry advertising information or other indicia.

It will of course be understood that the present invention has been described above purely by way of example, and modifications of detail can be made within the scope of the invention.

I claim:

1. A privacy booth comprising:

a plurality of partition members pivotably mounted together for movement from a storage position in which the partition members are in superimposed side-by-side relationship to an in-use position in which the partition members extend substantially radially away from a common vertical axis to define at least two separate compartments; a plurality of table tops pivotably connected to a respective one of the plurality of partition members and movable from a storage position in which the table top is folded against the partition member to an in-use position in which the table top extends between the adjacent ones of said plurality of partition members, wherein an area between adjacent ones of said plurality of partition members defines a compartment; and means for dismantling at least one of said plurality of partition members into a storage position thereby removing a single compartment, wherein remaining ones of said plurality of partition members remain in an in-use position.

2. A privacy booth as claimed in claim 1, further including adjustable support legs for each of said plurality of partition members thereby enabling adjustment of the height of the plurality of table tops.

3. A privacy booth as claimed in claim 2, wherein the outer edge of each of said plurality of partition members is hollow and accomodates a telescopic support leg.

4. A privacy booth comprising at least four partition members having inner and outer edges with said inner edges being pivoted together for movement of the partition members from a storage position in which the partition members are in superimposed side-by-side relationship to an in-use position in which the partition members extend substantially radially away from a common vertical axis to define a plurality of separate compartments equal in number to the number of partition members, the said outer edges of the partition members having respective legs which are extendable below the partition members to support the partition members above ground level, wherein one of each pair of partition members defining a compartment includes a table top having two side edges containing an angle of no greater than 90°with one of said side edges being pivoted along a substantially horizontal axis to the partition member, the table top being pivotable about said one side edge from a storage position in which the table top is folded up against the said partition member to an in-use position in which the other of said side edges engages substantially horizontally along the other partition member of the pair, whereby in the in-use position the table top extends substantially horizontally between the two partition members defining the compartment with the angle between the partition members being substantially equal to the said angle between the tow edges of the table top.

5. A privacy booth as claimed in claim 4, wherein the outer edges of the partition members are hollow and the said legs are accomodated telescopically within said outer edges.

* * * * *